US009213349B2

(12) United States Patent
Hu et al.

(10) Patent No.: US 9,213,349 B2
(45) Date of Patent: Dec. 15, 2015

(54) BANDGAP REFERENCE CIRCUIT AND SELF-REFERENCED REGULATOR

(71) Applicant: NOVATEK Microelectronics Corp., Hsin-Chu (TW)

(72) Inventors: Min-Hung Hu, Hsinchu (TW); Chiu-Huang Huang, Hsinchu County (TW); Chen-Tsung Wu, Kaohsiung (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 90 days.

(21) Appl. No.: 14/016,132

(22) Filed: Sep. 1, 2013

(65) Prior Publication Data

US 2014/0077789 A1 Mar. 20, 2014

(30) Foreign Application Priority Data

Sep. 20, 2012 (TW) ..... 101134414 A

(51) Int. Cl.

| | |
|---|---|
| ***G05F 3/16*** | (2006.01) |
| ***G05F 3/20*** | (2006.01) |
| ***G05F 3/02*** | (2006.01) |
| ***G05F 3/30*** | (2006.01) |

(52) U.S. Cl.

CPC ... *G05F 3/02* (2013.01); *G05F 3/30* (2013.01)

(58) Field of Classification Search

CPC ..... G05F 3/02; G05F 3/30
USPC ..... 323/311, 312, 313, 314, 315, 316, 317, 323/538, 539, 340, 341
See application file for complete search history.

(56) References Cited

U.S. PATENT DOCUMENTS

| | | | | |
|---|---|---|---|---|
| 4,524,318 | A * | 6/1985 | Burnham et al. | 323/313 |
| 5,001,414 | A * | 3/1991 | Brambilla et al. | 323/313 |
| 5,381,083 | A * | 1/1995 | Inamori et al. | 323/313 |
| 5,602,466 | A * | 2/1997 | Edwards | 323/313 |
| 5,804,958 | A | 9/1998 | Tsui | |
| 6,501,299 | B2 * | 12/2002 | Kim et al. | 326/83 |
| 6,529,066 | B1 * | 3/2003 | Guenot et al. | 327/539 |
| 7,166,994 | B2 * | 1/2007 | Lee et al. | 323/313 |
| 7,728,574 | B2 | 6/2010 | Kalyanaraman | |

FOREIGN PATENT DOCUMENTS

| | | |
|---|---|---|
| CN | 101052933 A | 10/2007 |
| TW | 201104381 | 2/2011 |
| TW | 201111942 | 4/2011 |

(Continued)

*Primary Examiner* — Jue Zhang
(74) *Attorney, Agent, or Firm* — Winston Hsu; Scott Margo

(57) ABSTRACT

The present invention discloses a bandgap reference circuit. The bandgap reference circuit includes an operational transconductance amplifier, and a reference generation circuit. The operational transconductance amplifier includes a self-biased operational transconductance amplifier, for utilizing an area difference between bipolar junction transistors of an input pair to generate a first positive temperature coefficient current to bias the input pair, and generating a positive temperature coefficient control voltage and a negative temperature coefficient control voltage; and a feedback voltage amplifier, for amplifying the negative temperature coefficient control voltage, and outputting a reference voltage to the input pair for feedback, to generate a first negative temperature coefficient current. The reference generation circuit generates a summation voltage or a summation current according to the positive temperature coefficient control voltage and the negative temperature coefficient control voltage.

19 Claims, 12 Drawing Sheets

(56) References Cited

FOREIGN PATENT DOCUMENTS

| | | |
|---|---|---|
| TW | 201124812 | 7/2011 |
| TW | 201205229 | 2/2012 |
| TW | 201222194 | 6/2012 |

* cited by examiner

BANDGAP REFERENCE CIRCUIT AND SELF-REFERENCED REGULATOR

BACKGROUND OF THE INVENTION

1. Field of the Invention

The present invention relates to a bandgap reference circuit and a related dual-output self-referenced regulator, and more particularly, to a bandgap reference circuit and a related dual-output self-referenced regulator having low system voltage and small layout area.

2. Description of the Prior Art

With the advancement of digital product, a large number of applications for handheld devices appear. Such applications utilize lower system voltage for reducing power consumption. If the circuits of such applications require a reference voltage which does not change with temperature, the circuits needs to utilize a bandgap reference circuit which can be applied in low system voltage operations and can simultaneously provide the low reference voltage.

For example, please refer to FIG. 1, which illustrates a schematic diagram of a conventional bandgap reference circuit 10. As shown in FIG. 1, in the bandgap reference circuit 10, a positive input terminal and a negative input terminal of an operational transconductance amplifier 100 form a virtual short via a negative feedback of the operational transconductance amplifier 100 to make an input voltage $V_{IN+}$ of the positive input terminal and an input voltage $V_{IN-}$ of the negative input terminal to be equal ($V_{IN+}=V_{IN-}=V_{BE2}$). A positive temperature coefficient current $I_D$ can be generated through a base-to-emitter voltage difference $V_{BE2}-V_{BE1}$ which is generated by an area difference between bipolar junction transistors Q1 and Q2 with a specific areas ratio of 1:K and a resistor R with a resistance of R. (i.e. a voltage cross the resistor R is $V_{BE2}-V_{BE1}$), and is shown as equation (1):

$$I_D = \frac{V_{BE2} - V_{BE1}}{R} = \frac{V_T \cdot \ln(K)}{R} \tag{1}$$

Since the thermal voltage $V_T$ of the bipolar junction transistors Q1 and Q2 is a positive temperature coefficient, as can be seen from equation (1), the positive temperature coefficient current $I_D$ flowing through the resistor R has a positive temperature coefficient.

On the other hand, since the input voltage $V_{IN+}$ of the positive input terminal is equal to the base-to-emitter voltage difference $V_{BE2}$, a negative temperature coefficient current $I_D'$ can be generated through a resistor $R_L$ of a resistance of L*R as shown in equation (2):

$$I_D' = \frac{V_{BE2}}{L*R} \tag{2}$$

Besides, since the base-to-emitter voltage difference $V_{BE2}$ has a negative temperature coefficient, the negative temperature coefficient current $I_D'$ flowing through the resistor $R_L$ has a negative temperature coefficient. As a result, by adjusting the resistance L*R of the resistor $R_L$ properly (i.e. a ratio resistance of the resistor $R_L$ and the resistor R), a zero temperature coefficient current $I_{REF}$ can be generated by summing up the positive temperature coefficient current $I_D$ and the negative temperature coefficient current $I_D'$ as shown in the equation (3):

$$I_{REF} = \frac{V_T \ln K}{R} + \frac{V_{BE2}}{L*R} \tag{3}$$

$$\frac{\partial I_{REF}}{\partial T} = \frac{\ln K}{R} * \frac{\partial V_T}{\partial T} + \frac{1}{L*R} * \frac{\partial V_{BE2}}{\partial T} = 0$$

$$\Rightarrow L = -\frac{\frac{\partial V_{BE2}}{\partial T}}{\frac{\partial V_T}{\partial T}\ln K} \approx -\frac{-1.6}{0.085 \ln K},$$

wherein the base-to-emitter voltage difference $V_{BE2}$ and the thermal voltage $V_T$ have a negative temperature coefficient −1.6 mv/C and a positive temperature coefficient 0.085 mv/C a partial differentiation on the temperature variable. Therefore, from the equation (3), when the ratio L between the resistors R and $R_L$ is L=1.6/0.085 lnK, the zero temperature coefficient current $I_{REF}$ has a zero temperature coefficient. After the zero temperature coefficient current $I_{REF}$ is mirrored and outputted to a resistor $R_{REF}$ by a current mirror, a zero temperature coefficient voltage $V_{REF}$ can be obtained. The zero temperature coefficient voltage $V_{REF}$ is not limited to the resistance of the resistors R and $R_L$ and can be adjusted to a voltage between 0V~(VDD−$V_{DS}$)=0V~(VDD−0.2V) via the resistance of the resistors $R_{REF}$.

However, under such a structure, for a normal operation of the bandgap reference circuit 10, a system voltage VDD must satisfy a condition of VDD≥$V_{GS}$+2·$V_{DS}$≅0.8V+2·0.2V=1.2V (i.e. a path P1 from the system voltage VDD to a ground terminal). Therefore, although the bandgap reference circuit 10 may meet the requirements for a portion of low voltage bandgap reference circuits, the bandgap reference circuit 10 still can not satisfy applications with the system voltage of 1V. (as the above applications for the handheld devices which utilize the lower system voltage for reducing power consumption.)

Besides, although the operational transconductance amplifier 100 can lock the input voltage $V_{IN+}$ and $V_{IN-}$ under the low system voltage condition, the operational transconductance amplifier 100 increases circuit complexity, layout area, and circuit power consumption in comparison with a general bandgap reference circuit which does not require operating under low voltage. Moreover, an error between the input voltage $V_{IN+}$ and the input voltage $V_{IN-}$ may be increased due to a process mismatch of an input pair of the operational transconductance amplifier 100, so as to affect the temperature coefficient of the zero temperature coefficient current $I_{REF}$ and the temperature coefficient of the zero temperature coefficient voltage $V_{REF}$, such that the zero temperature coefficient current $I_{REF}$ and the zero temperature coefficient voltage $V_{REF}$ do not completely have a zero temperature coefficient.

In addition, in comparison with the general bandgap reference circuit which does not require operating under low voltage, the above structure needs to utilize an additional resistor $R_L'$ to balance a current flowing through the resistor $R_L$. In addition to increasing additional layout area and circuit power consumption, the temperature coefficient of the zero temperature coefficient current $I_{REF}$ and the temperature coefficient of the zero temperature coefficient voltage $V_{REF}$ may also be affected when the resistors $R_L'$ and $R_L$ are mismatched (i.e. the resistance ratio L between the resistors $R_L'$ and $R_L$ does not satisfy the condition in equation (3)), such that the zero temperature coefficient current $I_{REF}$ and the zero temperature coefficient voltage $V_{REF}$ do not completely have a zero temperature coefficient.

On the other hand, please refer to FIG. 2, which illustrates a schematic diagram of a conventional bandgap reference circuit 20. As shown in FIG. 2, the bandgap reference circuit 20 is partially similar to the bandgap reference circuit 10, so the components and signals with similar functions are denoted by the same symbols. The main difference between the bandgap reference circuit 20 and the bandgap reference circuit 10 is that the bandgap reference circuit 20 utilizes two resistors R1, R2 and two resistors R1', R2' to replace the resistor $R_L$ and the resistor $R_L$' (a sum of the resistance of the two resistors R1, R2 and a sum of the resistance of the two resistors $R_1$', $R_2$' are also L*R). A positive input terminal and a negative input terminal of an operational transconductance amplifier 200 are coupled to a junction between the two resistors R1, R2 and a junction between the two resistors $R_1$', $R_2$'. The operational transconductance amplifier 200 utilizes an input pair structure of P-type metal oxide semiconductor (MOS) transistors to replace the original input pair structure of N-type MOS transistors in the operational transconductance amplifier 100 to adapt to the adjusted input voltage $V_{IN+}$ and $V_{IN-}$.

In such a condition, since the voltage of the junction of the two resistors R1, R2 and the voltage of the junction of the two resistors $R_1$' and $R_2$' are equal due to the virtual short and the resistance of the two resistors R1 and R2 are equal to the resistance of the two resistors $R_1$' and $R_2$', voltages below the current mirror can also be locked to the base-to-emitter voltage difference $V_{BE1}$ of the bipolar junction transistor Q1. The same zero temperature coefficient current $I_{REF}$ and the same zero temperature coefficient voltage $V_{REF}$ may also be obtained by referring to the above description of the bandgap reference circuit 10.

Under such a structure, for a normal operation of the bandgap reference circuit 20, the system voltage VDD must satisfy a condition of $$VDD \geq V_{SG} + V_{SD} + V_{BE2} \cdot \left(\frac{R_1'}{R_1' + R_2'}\right) \cong 0.8V + 0.2V + V_{BE2} \cdot \left(\frac{R_1'}{R_1' + R_2'}\right) > 1V$$

(i.e. a path P2 from the system voltage VDD to the ground terminal).

However, although the required lowest system voltage VDD in the structure of the bandgap reference circuit 20 may decrease by a voltage $V_{SD}$=0.2V in comparison with the structure of the bandgap reference circuit 10 by the method of the resistor divider (by adjusting the resistance of the resistor $R_2$' to be much greater than the resistance of the resistor $R_1$'), the structure of the bandgap reference circuit 20 also needs to utilizes the operational transconductance amplifier 200 to lock the input voltage $V_{IN+}$ and $V_{IN-}$ and the two resistors $R_1$', $R_2$' to balance a current flowing through the two resistors $R_1$, $R_2$, and thus has the shortcomings of the bandgap reference circuit 10.

On the other hand, please refer to FIG. 3, which illustrates a schematic diagram of a conventional bandgap reference circuit 30. As shown in FIG. 3, the bandgap reference circuit 30 is partially similar to the bandgap reference circuit 10, so the components and signals with similar functions are denoted by the same symbols. The main difference between the bandgap reference circuit 30 and the bandgap reference circuit 10 is that an operational transconductance amplifier 300 which removes a tail-current-source 102 for balancing the current in the original operational transconductance amplifier 100 is applied, and an input pair of NPN bipolar junction transistors Q1' and Q2' is utilized to replace the original input pair structure of N-type MOS transistors, such that a current of the input pair Q1' and Q2' may be controlled by the bipolar junction transistors Q1 and Q2 through a current mirror Q1-Q1' and a current mirror Q2-Q2'. The same zero temperature coefficient current $I_{REF}$ and the same zero temperature coefficient voltage $V_{REF}$ may also be obtained by referring to the above description of the bandgap reference circuit 10.

Under such a structure, for a normal operation of the bandgap reference circuit 30, the system voltage VDD must satisfy a condition of VDD≥max($V_{BE}$+$V_{SD}$,$V_{SG}$+$V_{DS}$)≅max(0.6V+0.2V,0.8V+0.2V)=1V (i.e. a path P3 or a path P4 from the system voltage VDD to the ground terminal). However, although the structure of the bandgap reference circuit 30 removes the tail-current-source 102 of the operational transconductance amplifier by utilizing the current mirror, such that the required lowest system voltage VDD in the structure of the bandgap reference circuit 30 may decrease a voltage $V_{DS}$=0.2V in comparison with the structure of the bandgap reference circuit 10, the structure of the bandgap reference circuit 30 also needs to utilize the operational transconductance amplifier 300 to lock the input voltage $V_{IN+}$ and $V_{IN-}$ and utilize the resistor $R_L$' to balance the current flowing through the two resistor $R_L$ and thus has the shortcoming of the bandgap reference circuit 10.

As can be seen from the above, since the conventional bandgap reference circuit for low system voltage utilizes the conventional operational transconductance amplifier to lock the input voltage of the input terminals to generate the positive temperature coefficient current and needs the additional resistors to balance the circuit for generating the negative temperature coefficient current, the circuit structure is complex. Thus, there is a need for improvement of the prior art.

SUMMARY OF THE INVENTION

It is therefore an objective of the present invention to provide a bandgap reference circuit and a related dual-output self-referenced regulator having low system voltage and small layout area.

The present invention discloses a bandgap reference circuit. The bandgap reference circuit comprises a dual-output self-referenced regulator, comprising a self-biased operational transconductance amplifier, for utilizing an area difference between bipolar junction transistors of an input pair to generate a first positive temperature coefficient current to bias the input pair, and generating a positive temperature coefficient control voltage and a negative temperature coefficient control voltage; and a feedback voltage amplifier, for amplifying the negative temperature coefficient control voltage, and outputting a reference voltage to the input pair for feedback, to generate a first negative temperature coefficient current; and a reference generation circuit, for generating a summation voltage or a summation current according to the positive temperature coefficient control voltage and the negative temperature coefficient control voltage.

The present invention further discloses a dual-output self-referenced regulator, for a bandgap reference circuit. The dual-output self-referenced regulator comprises a self-biased operational transconductance amplifier, for utilizing an area difference between bipolar junction transistors of an input pair to generate a first positive temperature coefficient current to bias the input pair, and generating a positive temperature coefficient control voltage and a negative temperature coefficient control voltage; and a feedback voltage amplifier, for amplifying the negative temperature coefficient control voltage, and outputting a reference voltage to the input pair for feedback, to generate a first negative temperature coefficient current.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
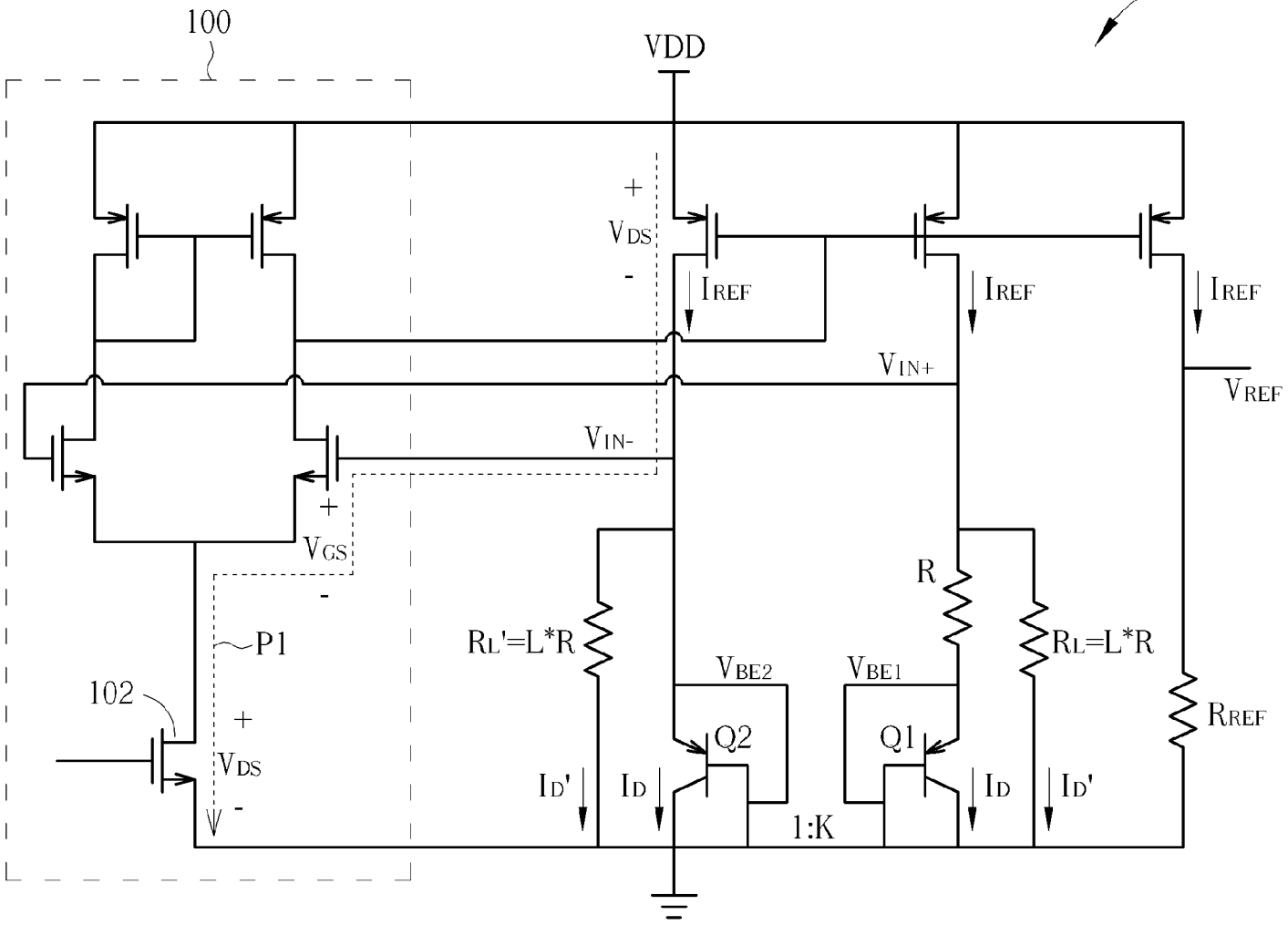
FIG. 1 PRIOR ART
FIG. 1 illustrates a schematic diagram of a conventional bandgap reference circuit.
Figure 2:
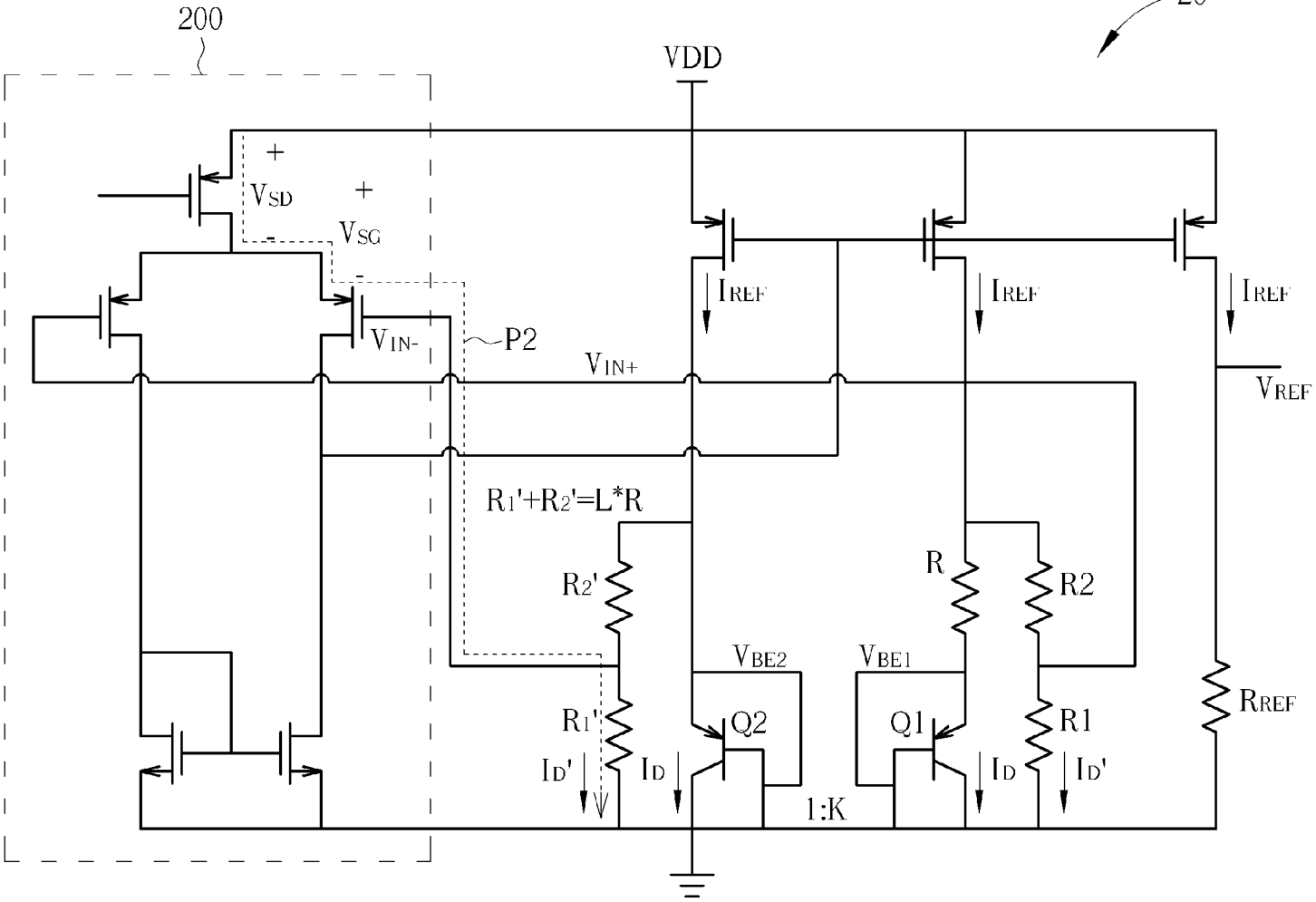
FIG. 2 PRIOR ART
FIG. 2 illustrates a schematic diagram of another conventional bandgap reference circuit.
Figure 3:
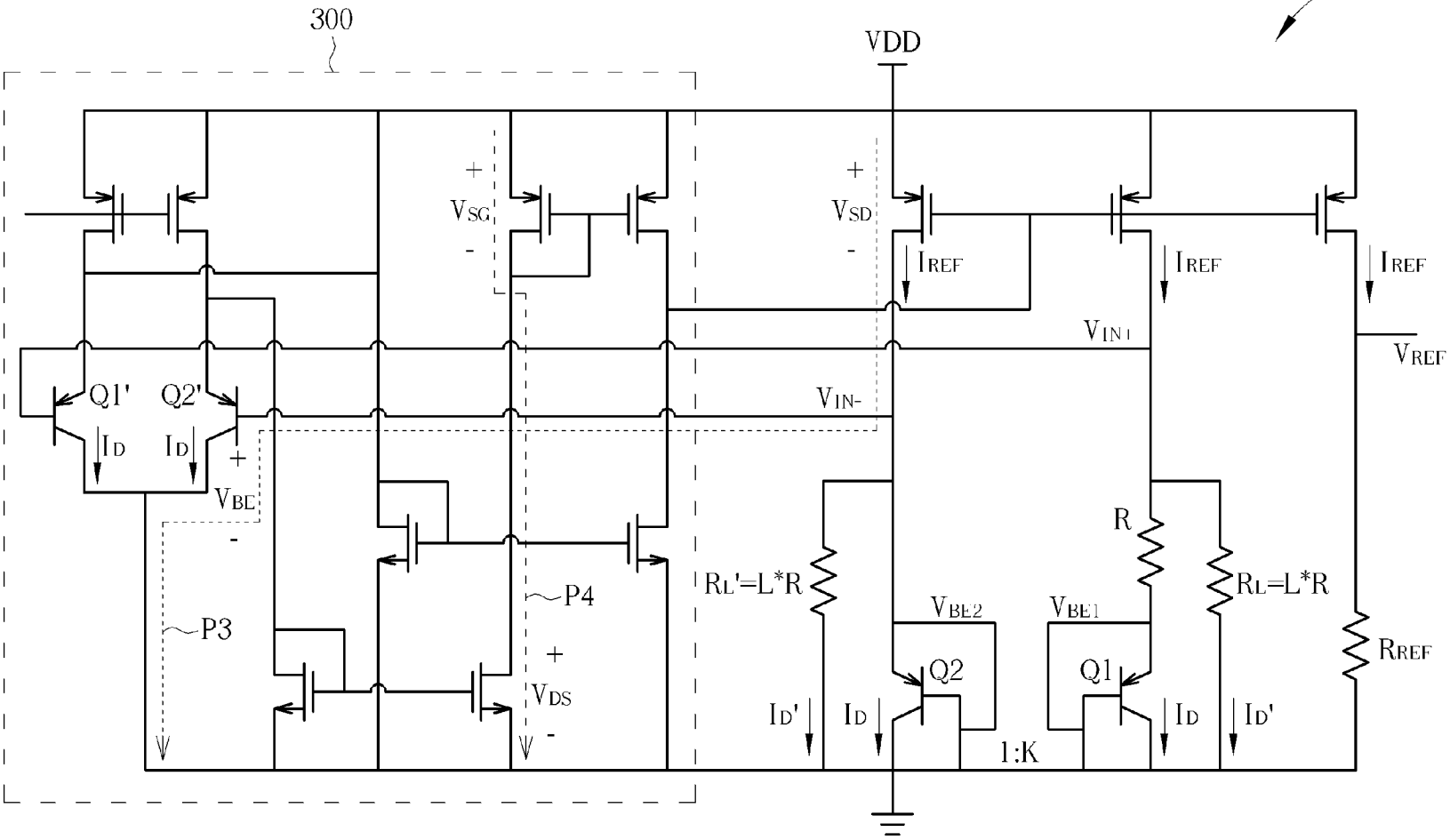
FIG. 3 PRIOR ART
FIG. 3 illustrates a schematic diagram of another conventional bandgap reference circuit.
Figure 4:
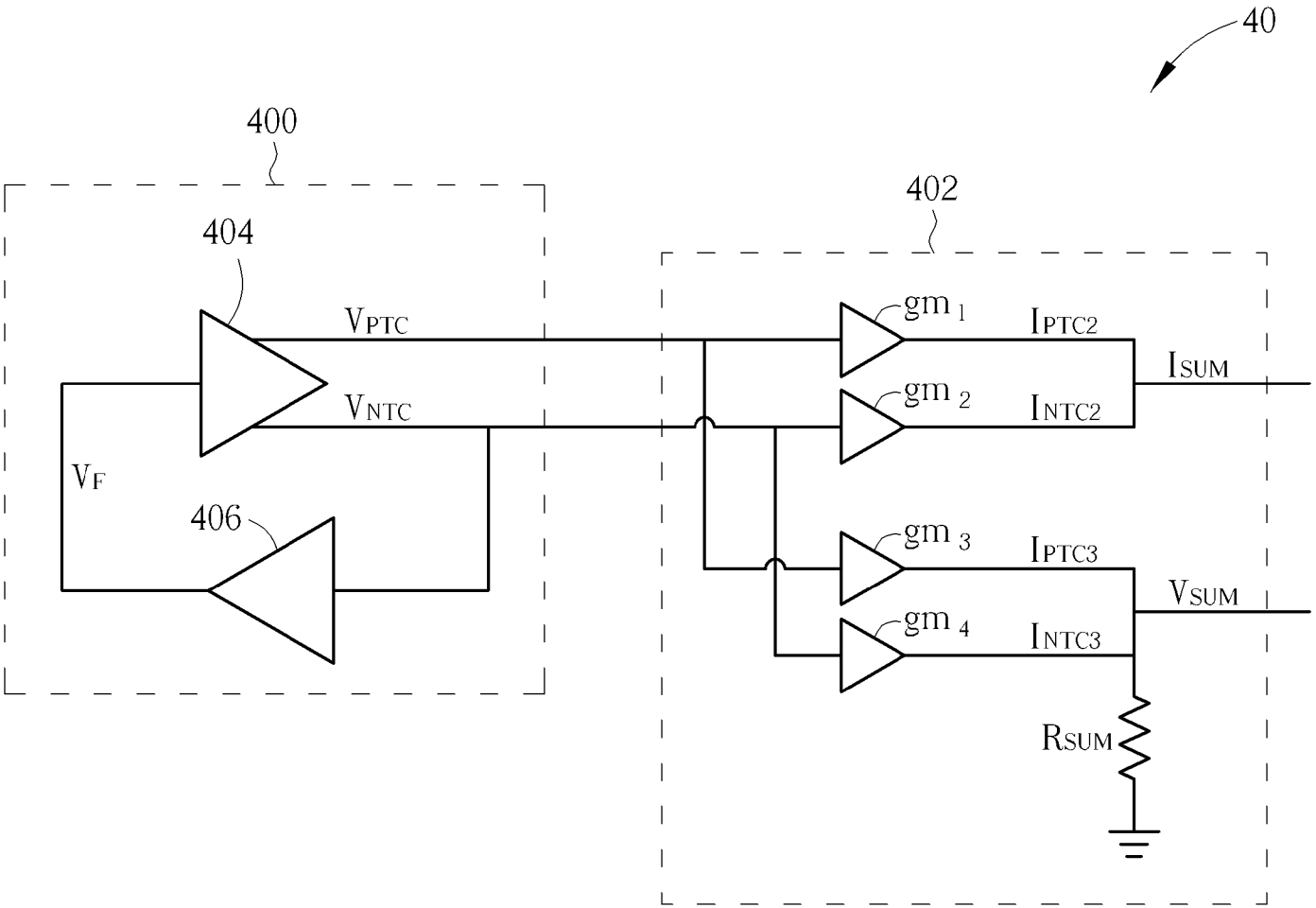
FIG. 4 illustrates a schematic diagram of a bandgap reference circuit according to an embodiment of the present invention.

Please refer to FIG. 4, which illustrates a schematic diagram of a bandgap reference circuit 40 according to an embodiment of the present invention. As shown in FIG. 4, the bandgap reference circuit 40 includes a dual-output self-referenced regulator 400 and a reference generation circuit 402. In short, the dual-output self-referenced regulator 400 includes a self-biased operational transconductance amplifier 404 and a feedback voltage amplifier 406. The self-biased operational transconductance amplifier 404 utilizes an area difference between bipolar junction transistors of an input pair to generate a positive temperature coefficient current $I_{PTC1}$ to bias the input pair, and generates a positive temperature coefficient control voltage $V_{PTC}$ and a negative temperature coefficient control voltage $V_{NTC}$. The feedback voltage amplifier 406 amplifies the negative temperature coefficient control voltage $V_{NTC}$, and outputs a reference voltage $V_F$ to the input pair of the self-biased operational transconductance amplifier 404 for feedback to generate a negative temperature coefficient current $I_{NTC1}$.

In such a condition, the self-biased operational transconductance amplifier 404 utilizes the area difference between the bipolar junction transistors of the input pair to generate the positive temperature coefficient current $I_{PTC1}$ for performing self-bias to the input pair and balance the current. Therefore, the self-biased operational transconductance amplifier 404 does not require a tail-current-source as shown in the prior art for balancing the current, so as to reduce a required system voltage VDD. In comparison with the conventional bandgap reference circuit, a method for generating the positive temperature coefficient current $I_{PTC1}$ and a method for generating the negative temperature coefficient current $I_{NTC1}$ by the feedback voltage amplifier 406 outputting the reference voltage $V_F$ to the input pair in the self-biased operational transconductance amplifier 404 for performing self reference may reduce the basic required circuits. As a result, since the dual-output self-referenced regulator 400 utilizes the self-biased method and the self-referenced method to generate the positive temperature coefficient current $I_{PTC1}$ and the negative temperature coefficient current $I_{NTC1}$, the dual-output self-referenced regulator 400 requires less circuits in the application for the low system voltage VDD.

On the other hand, since the positive temperature coefficient control voltage $V_{PTC}$ and the negative temperature coefficient control voltage $V_{NTC}$ are related to the positive temperature coefficient current $I_{PTC1}$ and the negative temperature coefficient current $I_{NTC1}$, respectively, the reference generation circuit 402 may generate a summation voltage $V_{SUM}$ or a summation current $I_{SUM}$ according to the positive temperature coefficient control voltage $V_{PTC}$ and the negative temperature coefficient control voltage $V_{NTC}$. In detail, the reference generation circuit 402 includes transconductance amplifiers $gm_1$~$gm_4$ for converting the positive temperature coefficient control voltage $V_{PTC}$ and the negative temperature coefficient control voltage $V_{NTC}$ to the positive temperature coefficient control current $I_{PTC2}$, the negative temperature coefficient control current $I_{NTC2}$, the positive temperature coefficient control current $I_{PTC3}$, and the negative temperature coefficient control current $I_{NTC3}$. Then, the transconductance amplifiers $gm_1$~$gm_2$ sum up the positive temperature coefficient control current $I_{PTC2}$ and the negative temperature coefficient control current $I_{NTC2}$ to generate the summation current $I_{SUM}$, and the summation current $I_{SUM}$ can have a specific temperature coefficient or a zero temperature coefficient by a proper summation ratio (for example, adjusting gains of the transconductance amplifiers $gm_1$~$gm_2$). Similarly, the positive temperature coefficient control current $I_{PTC3}$ and the negative temperature coefficient control current $I_{NTC3}$ generated by the transconductance amplifiers $gm_3$~$gm_4$ can be summed up and flow through a resistor $R_{SUM}$ to generate a summation voltage $V_{SUM}$. The summation voltage $V_{SUM}$ can have a specific temperature coefficient or a zero temperature coefficient by proper summation ratio. As a result, the reference generation circuit 402 can generate the summation voltage $V_{SUM}$ and the summation current $I_{SUM}$, having the specific temperature coefficient or the zero temperature coefficient.

Figure 5:
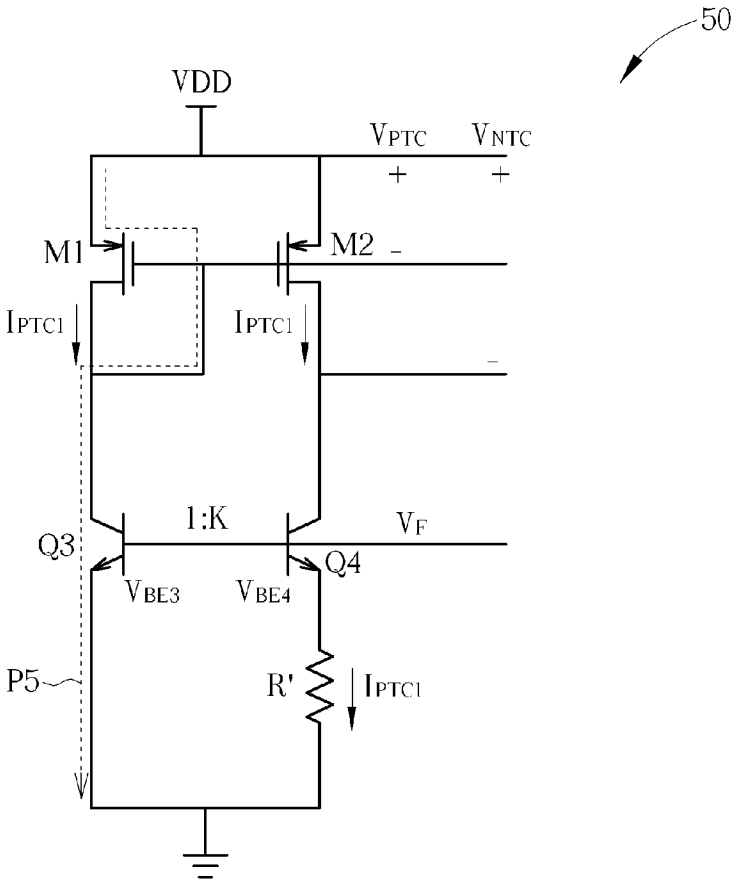
FIG. 5 illustrates a schematic diagram of a self-biased operational transconductance amplifier for implementing a self-biased operational transconductance amplifier in FIG. 4.

Specifically, please refer to FIG. 5, which illustrates a schematic diagram of a self-biased operational transconductance amplifier 50 for implementing the self-biased operational transconductance amplifier 404 in FIG. 4. As shown in FIG. 5, the self-biased operational transconductance amplifier 50 includes bipolar junction transistors Q3, Q4 and a resistor R', and a detailed structure and a connected method are shown in FIG. 5. That is, an emitter of the bipolar junction transistor Q3 is coupled to a ground terminal. An area of the bipolar junction transistor Q4 is specific multiple K of an area of the bipolar junction transistor Q3, and the bipolar junction transistor Q4 forms an input pair Q3-Q4 of the self-biased operational transconductance amplifier 50 with the bipolar junction transistor Q3. A base of the bipolar junction transistor Q4 is coupled to abase of the bipolar junction transistor Q3. A terminal of the resistor R' is coupled to an emitter of the bipolar junction transistor Q4 and another terminal of the resistor R' is coupled to the ground terminal.

In such a configuration, since the self-biased operational transconductance amplifier 50 utilizes the NPN bipolar junction transistors Q3, Q4 having an area ratio 1:K as the input pair, the positive temperature coefficient current $$I_{PTC1} = \frac{V_{BE3} - V_{BE4}}{R} = \frac{V_T \cdot \ln(K)}{R}$$

flowing through the resistor R' can be generated through a base-to-emitter voltage difference $V_{BE3}-V_{BE4}$, which is caused by an area difference between the bipolar junction transistors Q3, Q4, and the resistor R' of the resistance R (i.e. a voltage cross the resistor R' is $V_{BE3}-V_{BE4}$) and biases the input pair Q3-Q4. Besides, from the foregoing description related to the positive temperature coefficient current $I_D$, the positive temperature coefficient current $I_{PTC1}$ also has a positive temperature coefficient.

On the other hand, the self-biased operational transconductance amplifier 50 further includes a current mirror M1-M2. A source of a metal oxide semiconductor (MOS) transistor M1 of the current mirror M1-M2 is coupled to the system voltage VDD, a gate of the MOS transistor M1 is coupled to a drain of the MOS transistor M1, and the drain of the MOS transistor M1 is coupled to a collector of the bipolar junction transistors Q3. A source of a MOS transistor M2 of the current mirror M1-M2 is coupled to the system voltage VDD, a gate of the MOS transistor M2 is coupled to a gate of the MOS transistor M1, and a drain of the MOS transistor M2 is coupled to a collector of the bipolar junction transistors Q4. In such a configuration, the current mirror M1-M2 can mirror the positive temperature coefficient current $I_{PTC1}$ of a branch of the MOS transistor M2 to a branch of the MOS transistor M1. As a result, since the input pair Q3-Q4 of the self-biased operational transconductance amplifier 50 is self-biased and does not require the tail-current-source in the prior art for balancing the current. Therefore, the system voltage VDD only needs to satisfy a condition of $VDD \geq V_{SG}+V_{CE} \cong 0.8V+0.2V=1V$ (i.e. a path P5 from the system voltage VDD to the ground terminal), and thus the required system voltage VDD is lower and the positive temperature coefficient $I_{PTC1}$ outputted from the MOS transistor M1 has a positive temperature coefficient. As a result, a source-to-drain voltage difference of the MOS transistor M1 can form the positive temperature coefficient control voltage $V_{PTC}$ having a positive temperature coefficient.

Figure 6:
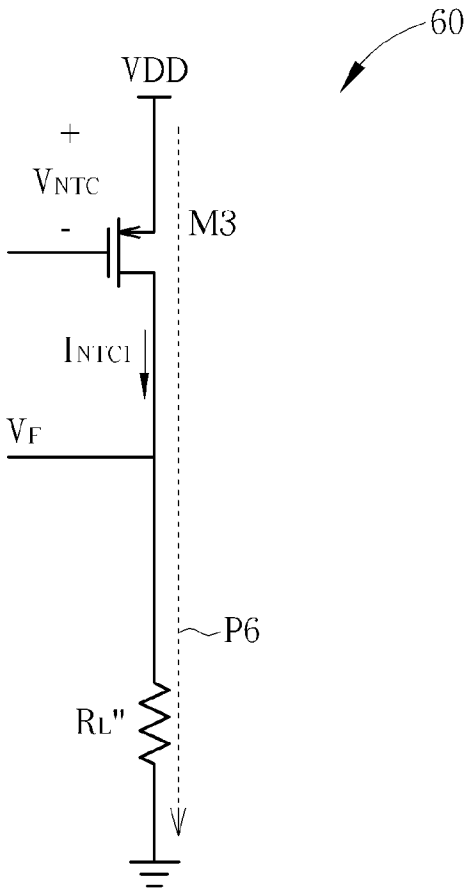
FIG. 6 illustrates a schematic diagram of a feedback voltage amplifier for implementing a feedback voltage amplifier in FIG. 4.

Besides, please refer to FIG. 6, which illustrates a schematic diagram of a feedback voltage amplifier 60 for implementing the feedback voltage amplifier 406 in FIG. 4. As shown in FIG. 6, the feedback voltage amplifier 60 includes a MOS transistor M3 and a resistor $R_L''$, and a detailed structure and a connected method are shown in FIG. 6. That is, a source of the MOS transistor M3 is coupled to the system voltage VDD, a gate of the MOS transistor M3 receives the negative temperature coefficient control voltage $V_{NTC}$ (i.e. a source-to-gate voltage difference of the MOS transistor M3 is equal to the negative temperature coefficient control voltage $V_{NTC}$). A terminal of the resistor $R_L''$ is coupled to a drain of the MOS transistor M3 and another terminal of the resistor $R_L''$ is coupled to the ground terminal. The drain of the MOS transistor M3 and the terminal of the resistor $R_L''$ are coupled to the input pair Q3-Q4 and output a reference voltage $V_F$ to the input pair Q3-Q4. The negative temperature coefficient control voltage $V_{NTC}$ is a difference between the system voltage VDD and an output voltage of the self-biased operational transconductance amplifier 50, i.e. a source-to-drain voltage difference of the MOS transistor M2 in FIG. 5.

In such a configuration, the MOS transistor M3 acts as an amplifier stage and receives the negative temperature coefficient control voltage $V_{NTC}$ outputted from the self-biased operational transconductance amplifier 50. Then, the reference voltage $V_F$ is generated through a transconductance of the MOS transistor M3 and an amplification of the resistor $R_L''$ of the resistance L*R, and is outputted to the input pair Q3-Q4 for feedback (i.e. the dual-output self-referenced regulator 400 is self-referenced and does not require an external reference voltage). As a result, since the reference voltage $V_F$ is equal to the base-to-emitter voltage difference $V_{BE3} \cong 0.6V$ of the bipolar junction transistors Q3 and has a negative temperature coefficient, the negative temperature coefficient current $$I_{NTC1} = \frac{V_{BE3}}{L * R}$$

generated from the MOS transistor M3 and flowing through the resistor $R_L''$ has a negative temperature coefficient, such that the source-to-gate voltage difference of the MOS transistor M3 forms the negative temperature coefficient control voltage $V_{NTC}$ having a negative temperature coefficient (i.e. since a voltage difference between the system voltage VDD and the output voltage of the self-biased operational transconductance amplifier 50 has a negative temperature coefficient, a source-to-drain voltage difference of the MOS transistor M2 has a negative temperature coefficient in FIG. 5). The system voltage VDD of the feedback voltage amplifier 60 only needs to satisfy a condition of $VDD \geq V_F+V_{SD}=V_{BE3}+V_{SD} \cong 0.6V+0.2V=0.8V$ (i.e. a path P6 from the system voltage VDD to the ground terminal), and the required system voltage VDD is lower.

Figure 7:
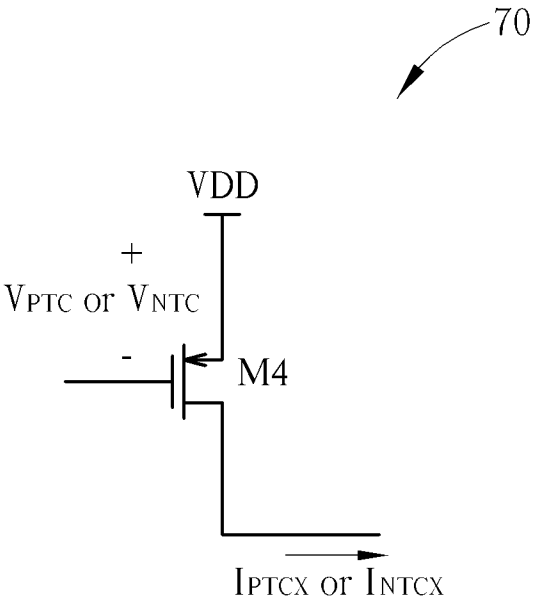
FIG. 7 illustrates a schematic diagram of a transconductance amplifier for implementing a transconductance amplifier among the transconductance amplifiers in FIG. 4.

On the other hand, please refer to FIG. 7, which illustrates a schematic diagram of a transconductance amplifier 70 for implementing a transconductance amplifier $gm_X$ among the transconductance amplifiers $gm_1$~$gm_4$ in FIG. 4. As shown in FIG. 7, the transconductance amplifier 70 includes a MOS transistor M4, and a detailed structure and a connected method are shown in FIG. 7. That is, a source of the MOS transistor M4 is coupled to the system voltage VDD, a gate of the MOS transistor M4 is utilized for receiving the positive temperature coefficient control voltage $V_{PTC}$ or the negative temperature coefficient control voltage $V_{NTC}$ (i.e. a source-to-gate voltage difference of the MOS transistor M4 is equal to the positive temperature coefficient control voltage $V_{PTC}$ or the negative temperature coefficient control voltage $V_{NTC}$), and a drain of the MOS transistor M4 is utilized for outputting a positive temperature coefficient $I_{PTCX}$ or a negative temperature coefficient $I_{NTCX}$. In such a configuration, the MOS transistor M4 acts as an amplifier stage and receives the positive temperature coefficient control voltage $V_{PTC}$ or the negative temperature coefficient control voltage $V_{NTC}$. Then, the positive temperature coefficient $I_{PTCX}$ or the negative temperature coefficient $I_{NTCX}$ are amplified and converted to the positive temperature coefficient control voltage $V_{PTC}$ or the negative temperature coefficient control voltage $V_{NTC}$ through a transconductance of the MOS transistor M4.

Figure 8:
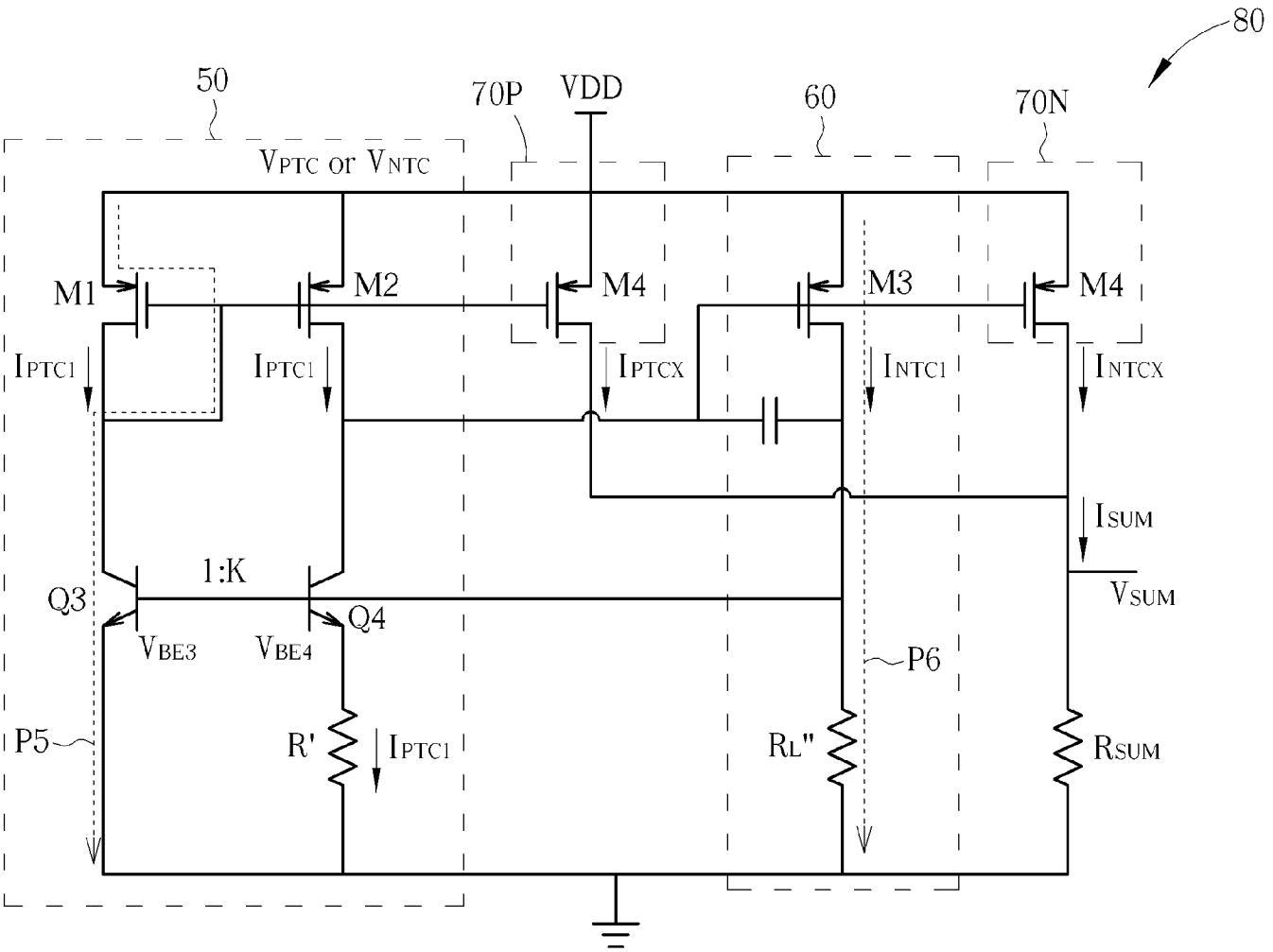
FIG. 8 illustrates a schematic diagram of a bandgap reference circuit for implementing the bandgap reference circuit in FIG. 4 by the self-biased operational transconductance amplifier 50 in FIG. 5, the feedback voltage amplifier 60 in FIG. 6, and the transconductance amplifier 70 in FIG. 7.

Furthermore, please refer to FIG. 8, which illustrates a schematic diagram of a bandgap reference circuit 80 for implementing the bandgap reference circuit 40 in FIG. 4 with the self-biased operational transconductance amplifier 50 in FIG. 5, the feedback voltage amplifier 60 in FIG. 6, and the transconductance amplifier 70 in FIG. 7. The transconductance amplifiers 70P and 70N are the same with the transconductance amplifier 70, provided that the transconductance amplifiers 70P and 70N receive the positive temperature coefficient control voltage $V_{PTC}$ and the negative temperature coefficient control voltage $V_{NTC}$ to output the positive temperature coefficient $I_{PTCX}$ and the negative temperature coefficient $I_{NTCX}$, respectively. In such a situation, the outputted summation voltage $V_{SUM}$ can be denoted as $$V_{SUM} = I_{SUM} \cdot R_{SUM} = (I_{PTCX} + I_{NTCX}) \cdot R_{SUM} = \frac{V_T \cdot \ln(K)}{R} \cdot R_{SUM} + \frac{V_{BE3}}{L * R} \cdot R_{SUM},$$

which is between 0V~(VDD−$V_{DS}$)=0V~(VDD−0.2V). The summation voltage $V_{SUM}$ may have the specific temperature coefficient or the zero temperature coefficient through a proper adjustment (similar with the method of adjusting the resistance ratio L between the resistors R, $R_L$ in the prior art). The system voltage VDD needs to satisfy a condition of $$VDD \geq \max(V_{CE}+V_{SG}, V_{BE3}+V_{SD}) \cong \max(0.2V+0.8V, 0.6V+0.2V)=1V$$

(i.e. the path P5 and the path P6 from the system voltage VDD to the ground terminal). As a result, in comparison with the conventional bandgap reference circuit for operating under low system voltage requires a large numbers of components, the basic circuit of the present invention only requires two bipolar junction transistors, five MOS transistors, a capacitor (as Miller capacitor for frequency compensation), and three resistors. Therefore, the present invention can significantly reduce numbers of required components, circuit power consumption and layout area, and decreases an error caused from the mismatch of the components.

Noticeably, the present invention utilizes the self-biased method and the self-referenced method to generate the positive temperature coefficient current $I_{PTC1}$ and the negative temperature coefficient current $I_{NTC1}$ to generate the summation voltage $V_{SUM}$ or the summation current $I_{SUM}$ having the specific temperature coefficient or the zero temperature coefficient, so as to use fewer circuits in the application for low system voltage operations. Those skilled in the art can make modifications or alterations accordingly. For example, the above embodiment utilizes the two transconductance amplifiers $gm_1$~$gm_2$ to generate the summation current $I_{SUM}$, and utilizes the two transconductance amplifiers $gm_3$~$gm_4$ and the resistor $R_{SUM}$ to generate the summation voltage $V_{SUM}$. However, in other embodiment, the other numbers of transconductance amplifiers also may be utilized to generate the summation voltage $V_{SUM}$ and the summation current $I_{SUM}$ having the specific temperature coefficient or the zero temperature coefficient. Besides, the above MOS transistors may be implemented by the transistors of other type and are not limited herein. The self-biased operational transconductance amplifier 404, the feedback voltage amplifier 406, and the reference generation circuit 402 may also be implemented by other circuit structures and are not limited to the above structures in FIG. 5-FIG. 8, as long as the functions can be achieved.

Figure 9:
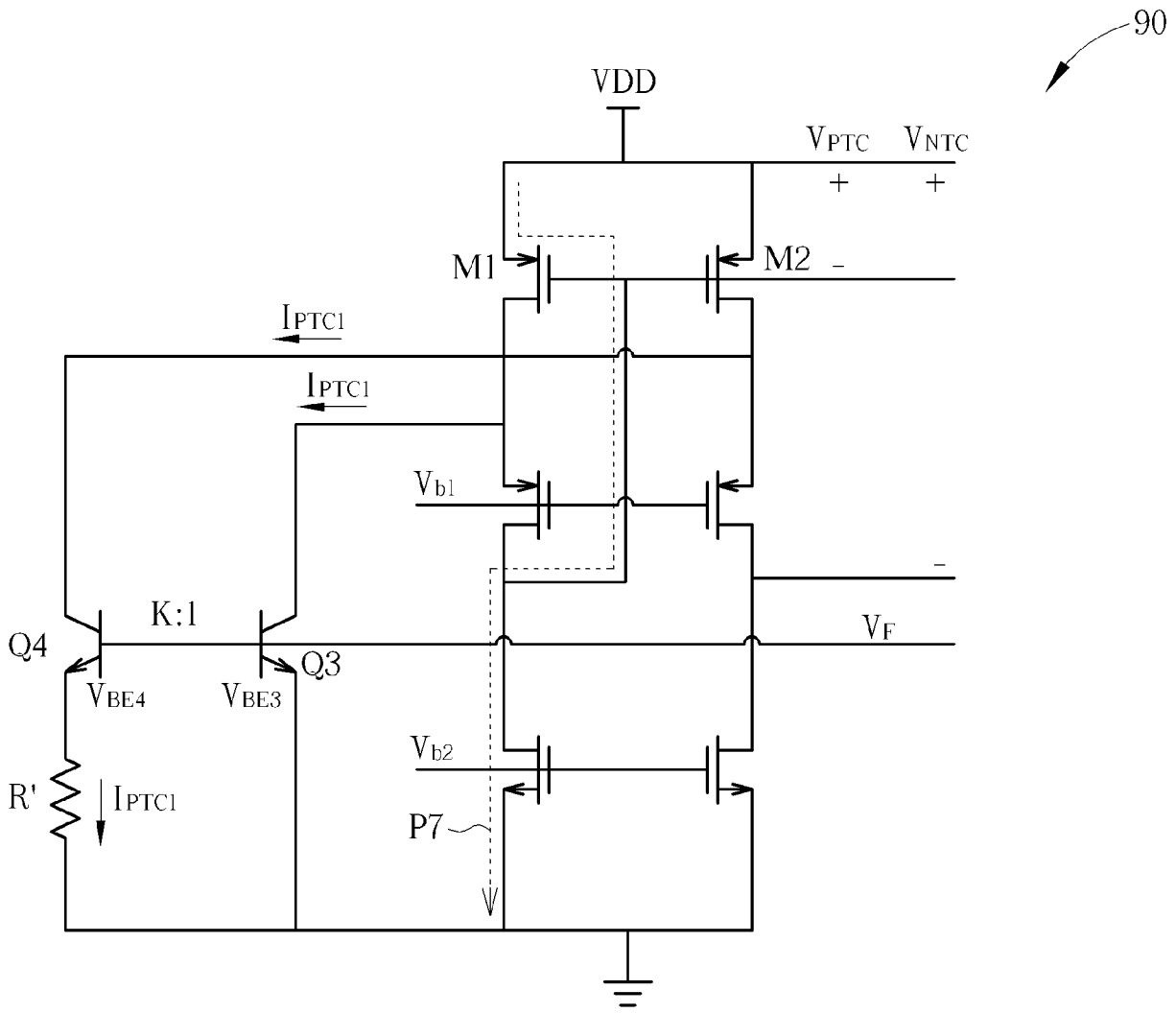
FIG. 9 illustrates a schematic diagram of a self-biased operational transconductance amplifier for implementing the self-biased operational transconductance amplifier in FIG. 4.

For example, please refer to FIG. 9, which illustrates a schematic diagram of a self-biased operational transconductance amplifier 90 for implementing the self-biased operational transconductance amplifier 404 in FIG. 4. As shown in FIG. 9, the self-biased operational transconductance amplifier 90 is partially similar to the self-biased operational transconductance amplifier 50, so the components and signals with similar functions are denoted by the same symbols. The main difference between the self-biased operational transconductance amplifier 90 and the self-biased operational transconductance amplifier 50 is that the self-biased operational transconductance amplifier 90 has a folded cascade structure (utilizing bias voltages $V_{b1}$ and $V_{b2}$ for bias).

In such a configuration, the negative temperature coefficient control voltage $V_{NTC}$ is a difference between the system voltage VDD and an output voltage of the self-biased operational transconductance amplifier 90, i.e. a sum of the source-to-drain voltage difference of the MOS transistor M2 and a source-to-drain voltage difference of a MOS transistor of the cascade stages in FIG. 9. The system voltage needs to satisfy a condition $$VDD \geq V_{SG}+V_{DS} \cong 0.8V+0.2V=1V$$

(i.e. a path P7 from the system voltage to the ground terminal). As a result, although the structure of the self-biased operational transconductance amplifier 90 is more complex than the self-biased operational transconductance amplifier 50, the output impendence of the folded cascade structure is larger, the ability of locking the output voltage is stronger, and the effect of channel length modulation can be effectively resisted to prevent the current varying with the drain-to-source voltage difference.

Figure 10:
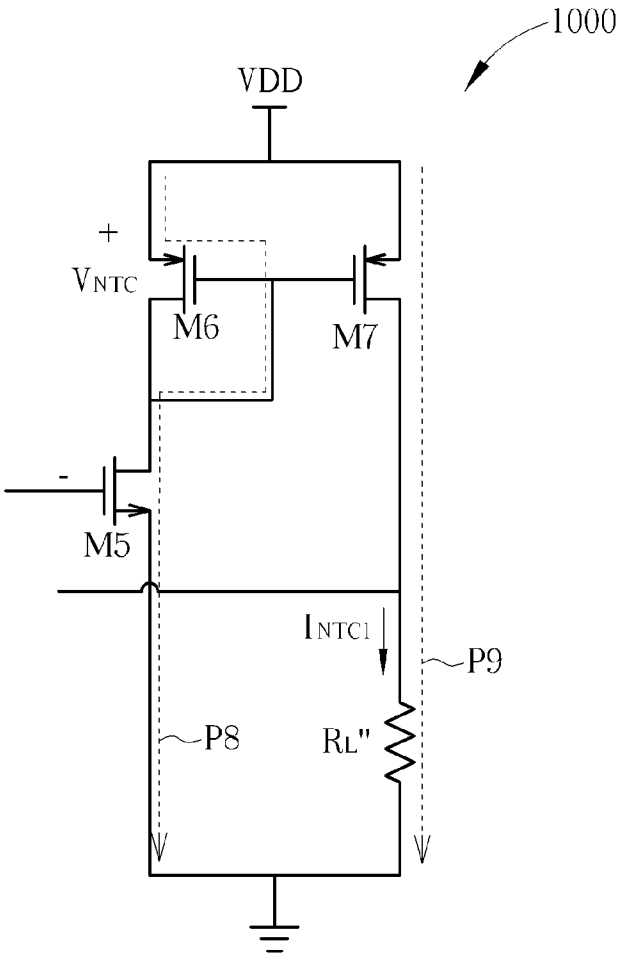
FIG. 10 illustrates a schematic diagram of a feedback voltage amplifier for implementing the feedback voltage amplifier in FIG. 4.

On the other hand, please refer to FIG. 10, which illustrates a schematic diagram of a feedback voltage amplifier 1000 for implementing the feedback voltage amplifier 406 in FIG. 4. As shown in FIG. 10, the feedback voltage amplifier 1000 is partially similar to the feedback voltage amplifier 60, so the components and signals with similar functions are denoted by the same symbols. The main difference between the feedback voltage amplifier 1000 and the feedback voltage amplifier 60 is that the feedback voltage amplifier 1000 utilizes an N-type MOS transistor M5 as an input to replace the P-type MOS transistor M3 as the input in the feedback voltage amplifier 60 and performs current inversion. A detailed structure and a connected method are shown in FIG. 10. That is, a gate of a MOS transistor M6 of a current mirror M6-M7 in the feedback voltage amplifier 1000 is coupled to a drain of the MOS transistor M6. Agate of a MOS transistor M7 is coupled to the gate of the MOS transistor M6. Agate of the MOS transistor M5 receives the negative temperature coefficient control voltage $V_{NTC}$ (i.e. a source-to-gate voltage difference of the MOS transistor M6 is equal to the negative temperature coefficient control voltage $V_{NTC}$), a drain of the MOS transistor M5 is coupled to the drain of the MOS transistor M6, and a source of the MOS transistor M5 is coupled to the ground terminal. A terminal of the resistor $R_L$" is coupled to a drain of the MOS transistor M7 and another terminal of the resistor $R_L$" is coupled to the ground terminal. The drain of the MOS transistor M7 and the terminal of the resistor $R_L$" are coupled to the input pair Q3-Q4 and output the reference voltage $V_F$ to the input pair Q3-Q4.

In such a configuration, since the reference voltage $V_F$ is equal to the base-to-emitter voltage difference $V_{BE3} \cong 0.6V$ of the bipolar junction transistors Q3 and has a negative temperature coefficient, the negative temperature coefficient current $$I_{NTC1} = \frac{V_{BE3}}{L * R}$$

generated from the MOS transistor M7 and flowing through the resistor $R_L''$ has a negative temperature coefficient, such that the source-to-gate voltage difference of the MOS transistor M7 and the source-to-gate voltage difference of the MOS transistor M6 have a negative temperature coefficient. Therefore, the source-to-gate voltage difference of the MOS transistor M6 can form the negative temperature coefficient control voltage $V_{NTC}$ having a negative temperature coefficient (i.e. the voltage difference between the system voltage VDD of the self-biased operational transconductance amplifier 50 or 90 and the drain voltage of the MOS transistor M5 has a negative temperature coefficient by the feedback). At this moment, the system voltage VDD needs to satisfy a condition of $$VDD \geq \max(V_{SG}+V_{DS}, V_F+V_{SD}) \cong \max(0.8V+0.2V, 0.6V+0.2V)=1V$$

(i.e. a path P8 and a path P9 from the system voltage VDD to the ground terminal).

Figure 11:
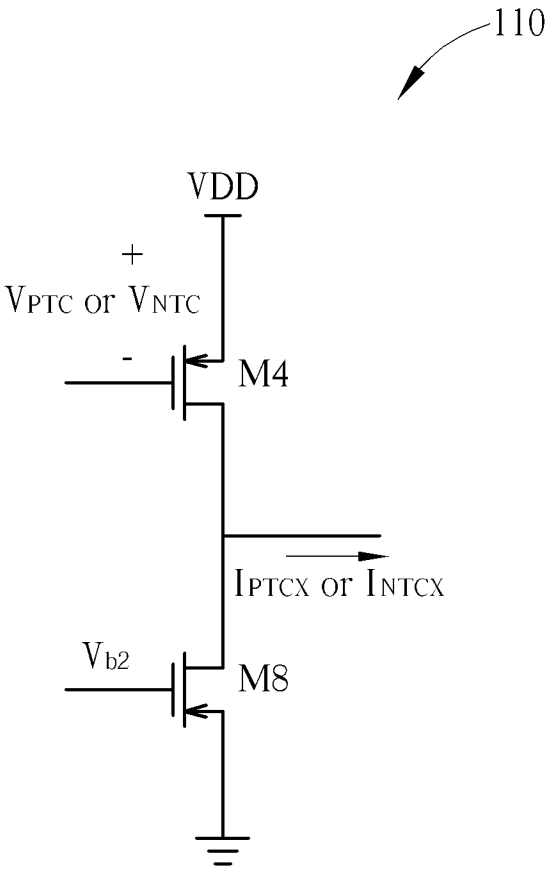
FIG. 11 illustrates a schematic diagram of a transconductance amplifier 110 for implementing a transconductance amplifier among the transconductance amplifiers in FIG. 4.

On the other hand, please refer to FIG. 11, which illustrates a schematic diagram of a transconductance amplifier 110 for implementing a transconductance amplifier $gm_X$ among the transconductance amplifiers $gm_1$~$gm_4$ in FIG. 4. As shown in FIG. 11, the transconductance amplifier 110 is partially similar to the transconductance amplifier 70, so the components and signals with similar functions are denoted by the same symbols. The main difference between the transconductance amplifier 110 and the transconductance amplifier 70 is that the transconductance amplifier 110 further includes a MOS transistor M8 and forms a current mirror with a MOS transistor in the folded cascade structure of the self-biased operational transconductance amplifier 90 in FIG. 9. A gate of the MOS transistor M8 is coupled to a gate of the MOS transistor in the folded cascade structure, a drain of the MOS transistor M8 is coupled to the drain of the MOS transistor M4.

In such a configuration, as shown in FIG. 11 together with FIG. 9, when the gate of the MOS transistor M4 receives the positive temperature coefficient control voltage $V_{PTC}$ outputted from the self-biased operational transconductance amplifier 90 having folded cascade structure, the current outputted from the drain of the MOS transistor M4 is related to a sum of the positive temperature coefficient current $I_{PTC1}$ in FIG. 9 and the current flowing the folded cascade structure. Therefore, in order to output the positive temperature coefficient current $I_{PTCX}$ related to the positive temperature coefficient current $I_{PTC1}$, the transconductance amplifier 110 further includes the MOS transistor M8 which forms the current mirror with the MOS transistor in the folded cascade structure of the self-biased operational transconductance amplifier 90, such that a current outputted from the drain of the MOS transistor M4 subtracted from a current flowing through the MOS transistor M8 is only related to the positive temperature coefficient current $I_{PTC1}$ and is outputted as the positive temperature coefficient current $I_{PTCX}$. Similarly, the same structures also can be utilized to receive the negative temperature coefficient control voltage $V_{NTC}$ to output the negative temperature coefficient current $I_{NTCX}$.

Figure 12:
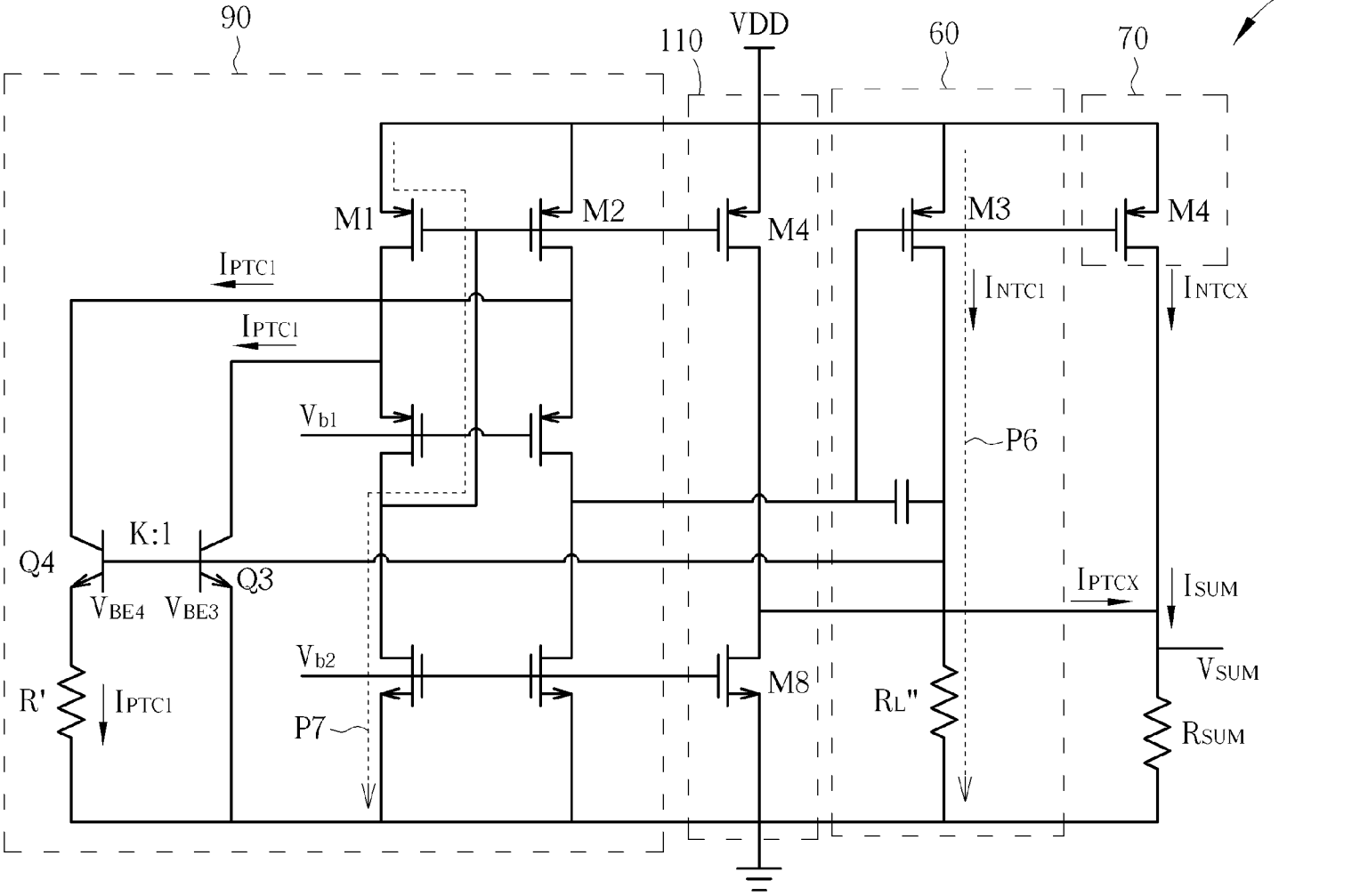
FIG. 12 illustrates a schematic diagram of a bandgap reference circuit for implementing the bandgap reference circuit in FIG. 4 by the self-biased operational transconductance amplifier in FIG. 9, the feedback voltage amplifier in FIG. 6, the transconductance amplifier in FIG. 7, and the transconductance amplifier in FIG. 11.

Furthermore, please refer to FIG. 12, which illustrates a schematic diagram of a bandgap reference circuit 120 for implementing the bandgap reference circuit 40 in FIG. 4 with the self-biased operational transconductance amplifier 90 in FIG. 9, the feedback voltage amplifier 60 in FIG. 6, the transconductance amplifier 70 in FIG. 7, and the transconductance amplifier 110 in FIG. 11. The transconductance amplifiers 110 and 70 receive the positive temperature coefficient control voltage $V_{PTC}$ and the negative temperature coefficient control voltage $V_{NTC}$ to output the positive temperature coefficient $I_{PTCX}$ and the negative temperature coefficient $I_{NTCX}$. In such a configuration, the outputted summation voltage $V_{SUM}$ can also be denoted as $$V_{SUM} = I_{SUM} \cdot R_{SUM} = (I_{PTCX} + I_{NTCX}) \cdot R_{SUM} = \frac{V_T \cdot \ln(K)}{R} \cdot R_{SUM} + \frac{V_{BE3}}{L * R} \cdot R_{SUM},$$

which is between 0V~(VDD−$V_{DS}$)=0V~(VDD−0.2V). The summation voltage $V_{SUM}$ can have the specific temperature coefficient or the zero temperature coefficient through a proper adjustment (similar with the method of adjusting the resistance ratio L between the resistors R, $R_L$ in the prior art), and the system voltage VDD needs to satisfy a condition of $$VDD \geq \max(V_{SG}+V_{DS}, V_{BE2}+V_{SD}) \cong \max(0.2V+0.8V, 0.6V+0.2V)=1V$$

(i.e. the paths P7 and P6 from the system voltage VDD to the ground terminal).

The above mentioned circuits of the self-biased operational transconductance amplifier, the feedback voltage amplifier, and the reference generation circuit can be combined for the actual requirement to implement the bandgap reference circuit, while still keeping respective functions and respective advantages, and realizations of the bandgap reference circuit are not limited to the bandgap reference circuit 80 and the bandgap reference circuit 120.

In the prior art, since the bandgap reference circuit for low system voltage operations utilizes the conventional structure of the operational transconductance amplifier to lock the input voltage to generate the positive temperature coefficient current and utilizes an additional resistor to balance the circuit for generating the negative temperature coefficient current, the circuit structure is more complex. In comparison, the present invention utilizes the self-biased structure and the self-referenced structure to generate the positive temperature coefficient current $I_{PTC1}$ and the negative temperature coefficient current $I_{NTC1}$, to generate the summation voltage $V_{SUM}$ or the summation current $I_{SUM}$ having the specific temperature coefficient or the zero temperature coefficient. Therefore, the present invention requires less basic circuits to be implemented in the application for the low system voltage VDD.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bandgap reference circuit, comprising:

a dual-output self-referenced regulator, comprising:

a self-biased operational transconductance amplifier, for utilizing an area difference between bipolar junction transistors of an input pair to generate a first positive temperature coefficient current to bias the input pair, and generating a positive temperature coefficient control voltage and a negative temperature coefficient control voltage; and a feedback voltage amplifier, for amplifying the negative temperature coefficient control voltage, and outputting a reference voltage to the input pair for feedback, to generate a first negative temperature coefficient current; and a reference generation circuit, for generating a summation voltage or a summation current according to the positive temperature coefficient control voltage and the negative temperature coefficient control voltage.

2. The bandgap reference circuit of claim 1, wherein the reference generation circuit comprises:

at least one transconductance amplifier, for converting the positive temperature coefficient control voltage and the negative temperature coefficient control voltage to at least one second positive temperature coefficient control current and at least one second negative temperature coefficient control current.

3. The bandgap reference circuit of claim 2, wherein the at least one transconductance amplifier summarizes at least two of the at least one second positive temperature coefficient control current and the at least one second negative temperature coefficient control current to generate the summation current, and the summation current has a specific temperature coefficient or a zero temperature coefficient.

4. The bandgap reference circuit of claim 2, further comprising:

a first resistor, for generating the summation voltage according to a sum of at least two of the at least one second positive temperature coefficient control current and the at least one second negative temperature coefficient control current, wherein the summation voltage has a specific temperature coefficient or a zero temperature coefficient.

5. The bandgap reference circuit of claim 1, wherein the self-biased operational transconductance amplifier comprises:

a first bipolar junction transistor, comprising an emitter, a base and a collector, wherein the emitter is coupled to a ground terminal;

a second bipolar junction transistor, having an area of a specific multiple of an area of the first bipolar junction transistor, forming the input pair with the first bipolar junction transistor, and comprising an emitter, a base and a collector, wherein the base is coupled to the base of the first bipolar junction transistor; and a second resistor, comprising a terminal coupled to the emitter of the second bipolar junction transistor, and another terminal coupled to the ground terminal;

wherein the first positive temperature coefficient current flows through the second resistor.

6. The bandgap reference circuit of claim 1, wherein the self-biased operational transconductance amplifier further comprises:

a first current mirror, comprising:

a first transistor, comprising a gate, a drain and a source, wherein the gate is coupled to the drain, and the drain is coupled to the collector of the first bipolar junction transistor; and a second transistor, comprising a gate, a drain and a source, wherein the gate is coupled to the gate of the first transistor, and the drain is coupled to the collector of the second bipolar junction transistor.

7. The bandgap reference circuit of claim 5, wherein a source-to-gate voltage difference of the first transistor is the positive temperature coefficient control voltage, and a voltage difference between a system voltage of the self-biased operational transconductance amplifier and an output voltage of the self-biased operational transconductance amplifier is the negative temperature coefficient control voltage.

8. The bandgap reference circuit of claim 5, wherein the self-biased operational transconductance amplifier has a folded cascade structure.

9. The bandgap reference circuit of claim 1, wherein the feedback voltage amplifier comprises:

a third transistor, comprising a gate, a drain and a source, wherein the gate is utilized for receiving the negative temperature coefficient control voltage; and a third resistor, comprising a terminal coupled to the drain of the third transistor, and another terminal coupled to a ground terminal;

wherein the drain of the third transistor and the terminal of the third resistor are coupled to the input pair and output the reference voltage to the input pair, and the first negative temperature coefficient current flows through the third resistor.

10. The bandgap reference circuit of claim 1, wherein the feedback voltage amplifier comprises:

a second current mirror, comprising:

a fourth transistor, comprising a gate, a drain and a source, wherein the gate is coupled to the drain; and a fifth transistor, comprising a gate, a drain and a source, wherein the gate is coupled to the gate of the fourth transistor;

a sixth transistor, comprising a gate, a drain and a source, wherein the gate is utilized for receiving the negative temperature coefficient control voltage, the drain is coupled to the drain of the fourth transistor, and the source is coupled to a ground terminal; and a fourth resistor, comprising a terminal coupled to the drain of the fifth transistor, and another terminal coupled to the ground terminal;

wherein the drain of the fifth transistor and the terminal of the fourth resistor are coupled to the input pair and output the reference voltage to the input pair, and the first negative temperature coefficient current flows through the fourth resistor.

11. The bandgap reference circuit of claim 2, wherein a first transconductance amplifier of the at least one transconductance amplifier comprises:

a seventh transistor, comprising a gate, a drain and a source, wherein the gate is utilized for receiving the positive temperature coefficient control voltage or the negative temperature coefficient control voltage, and the drain is utilized for outputting a second positive temperature coefficient current or a second negative temperature coefficient current.

12. The bandgap reference circuit of claim 2, wherein a second transconductance amplifier of the at least one transconductance amplifier comprises:

an eighth transistor, comprising a gate, a drain and a source, wherein the gate is utilized for receiving the negative temperature coefficient control voltage; and a ninth transistor, forming a third current mirror with a tenth transistor in a folded cascade structure of the self-biased operational transconductance amplifier, and comprising a gate, a drain and a source, wherein the gate is coupled to a gate of the tenth transistor and the drain is coupled to the drain of the eighth transistor;

wherein a second positive temperature coefficient current or a second negative temperature coefficient current is a current outputted from the drain of the eighth transistor minus a current flowing through the ninth transistor.

13. A dual-output self-referenced regulator, for a bandgap reference circuit, comprising:

a self-biased operational transconductance amplifier, for utilizing an area difference between bipolar junction transistors of an input pair to generate a first positive temperature coefficient current to bias the input pair, and generating a positive temperature coefficient control voltage and a negative temperature coefficient control voltage; and a feedback voltage amplifier, for amplifying the negative temperature coefficient control voltage, and outputting a reference voltage to the input pair for feedback, to generate a first negative temperature coefficient current.

14. The dual-output self-referenced regulator of claim 13, wherein the self-biased operational transconductance amplifier comprises:

a first bipolar junction transistor, comprising an emitter, a base and a collector, wherein the emitter is coupled to a ground terminal;

a second bipolar junction transistor, having an area of a specific multiple of an area of the first bipolar junction transistor, forming the input pair with the first bipolar junction transistor, and comprising an emitter, a base and a collector, wherein the base is coupled to the base of the first bipolar junction transistor; and a second resistor, comprising a terminal coupled to the emitter of the second bipolar junction transistor, and another terminal coupled to the ground terminal;

wherein the first positive temperature coefficient current flows through the second resistor.

15. The dual-output self-referenced regulator of claim 14, wherein the self-biased operational transconductance amplifier further comprises:

a first current mirror, comprising:

a first transistor, comprising a gate, a drain and a source, wherein the gate is coupled to the drain, and the drain is coupled to the collector of the first bipolar junction transistor; and a second transistor, comprising a gate, a drain and a source, wherein the gate is coupled to the gate of the first transistor, and the drain is coupled to the collector of the second bipolar junction transistor.

16. The dual-output self-referenced regulator of claim 14, wherein a source-to-gate voltage difference of the first transistor is the positive temperature coefficient control voltage, and a voltage difference between a system voltage of the self-biased operational transconductance amplifier and an output voltage of the self-biased operational transconductance amplifier is the negative temperature coefficient control voltage.

17. The dual-output self-referenced regulator of claim 14, wherein the self-biased operational transconductance amplifier has a folded cascade structure.

18. The dual-output self-referenced regulator of claim 13, wherein the feedback voltage amplifier comprises:

a third transistor, comprising a gate, a drain and a source, wherein the gate is utilized for receiving the negative temperature coefficient control voltage; and a third resistor, comprising a terminal coupled to the drain of the third transistor, and another terminal coupled to a ground terminal;

wherein the drain of the third transistor and the terminal of the third resistor are coupled to the input pair and output the reference voltage to the input pair, and the first negative temperature coefficient current flows through the third resistor.

19. The dual-output self-referenced regulator of claim 13, wherein the feedback voltage amplifier comprises:

a second current mirror, comprising:

a fourth transistor, comprising a gate, a drain and a source, wherein the gate is coupled to the drain; and a fifth transistor, comprising a gate, a drain and a source, wherein the gate is coupled to the gate of the fourth transistor;

a sixth transistor, comprising a gate, a drain and a source, wherein the gate is utilized for receiving the negative temperature coefficient control voltage, the drain is coupled to the drain of the fourth transistor, and the source is coupled to a ground terminal; and a fourth resistor, comprising a terminal coupled to the drain of the fifth transistor, and another terminal coupled to the ground terminal;

wherein the drain of the fifth transistor and the terminal of the fourth resistor are coupled to the input pair and output the reference voltage to the input pair, and the first negative temperature coefficient current flows through the fourth resistor.

* * * * *